US006289943B1

(12) United States Patent
Engle

(10) Patent No.: US 6,289,943 B1
(45) Date of Patent: Sep. 18, 2001

(54) SERGE APPLYING ASSEMBLY FOR A SEWING MACHINE

(75) Inventor: Elbert E. Engle, Steele, AL (US)

(73) Assignee: XYZ Control, Inc., Steele, AL (US)

( * ) Notice: Subject to any disclaimer, the term of this patent is extended or adjusted under 35 U.S.C. 154(b) by 0 days.

(21) Appl. No.: 09/771,504

(22) Filed: Jan. 26, 2001

(51) Int. Cl.[7] ..... D05B 1/20; D05B 37/02

(52) U.S. Cl. ..... 139/475.04; 139/122; 139/153; 139/324

(58) Field of Search ..... 112/475.04, 153, 112/324, 122, 7, 9

(56) References Cited

U.S. PATENT DOCUMENTS 4,307,675 * 12/1981 Off et al. ..... 112/121.29
5,170,733 * 12/1992 Honma et al. ..... 112/308
6,237,518 * 5/2001 Yunoki et al. ..... 112/470.33

* cited by examiner

*Primary Examiner*—Andy Falik
(74) *Attorney, Agent, or Firm*—Christopher A. Holland; Robert J. Veal; Burr & Forman LLP

(57) ABSTRACT

A serge applying assembly includes a sewing machine and a cutting assembly attached thereto. The sewing machine will sew the desired serge onto the edges surrounding a section of material by feeding the material between a pressure foot and a feed dog for engaging the material to be sewn and cut. A cutting assembly is included attached to the sewing machine proximate the sewing needle. The cutting assembly is able to engage the material and make a desired cut to aid the operator in applying serge around the perimeter of the material. The cutting assembly includes a pneumatic cylinder having a housing enclosing piston, with a blade mechanically connected to the piston of the pneumatic cylinder. The cutting assembly is attached to the sewing machine proximate the pressure foot, and is able to cut the material so that the operator can rotate the material for serge to be applied to a second edge of the material. This process is repeated until serge has been applied to the perimeter of the material.

14 Claims, 10 Drawing Sheets

SERGE APPLYING ASSEMBLY FOR A SEWING MACHINE

FIELD OF THE INVENTION

The present invention relates to an assembly for applying serge to the edge of a material to prevent the unraveling of the edge of the material. More specifically, the present invention relates to an assembly for continuously applying serge around the edge of a piece of material.

BACKGROUND OF THE INVENTION

Rugs, carpets, and throws are examples of various materials having edges that are commonly serge-finished to protect the edge of the material. Serge is typically applied to the edges of these materials using a conventional sewing or serging machine, with the operator of the sewing machine directing the application of serge to the edge of the material. The material is conventionally rectangular, and therefore has four edges to be processed. Once the serge has been sewn onto one edge of the carpet, the operator must make a perpendicular incision at the point in the material where the next edge is to begin, and the material must then be rotated for the next side edge of the carpet to have serge applied. As a result, to apply serge to each edge of the material, the operator must follow the following process: apply serge to one edge of the material, stop the operation of the sewing machine, cut an incision in the material with scissors at the point that the next edge is to be sewn, rotate the material at each intersecting edge, restart the operation of the sewing machine, and begin applying serge to the next edge of the material. Consequently, the process used to apply serge to the standard rectangular piece of material requires the operator to stop production to make four cuts on the material with a pair of scissors to be able align the desired edges to be serged.

This conventional method of applying serge creates several difficulties for the operator. First, for the operator to follow the steps of this method, it requires a substantial amount of time to make the required perpendicular incisions in the material at the edges that are to be serged. As stated above, for the operator to apply serge to each edge, the operator is required to stop the sewing of the edge, pick up a pair of scissors, cut the material at the desired location, rotate the material at the desired angle (preferably ninety degrees), and then begin sewing serge to the next edge. Since the edge of the material is preferably sewn on every side for conventional carpets, this process must be repeated approximately three times after the first edge to protect each individual edge of the rectangular piece of material. Consequently, the time required by the operator is significant when the operator has to make a cut in the edge of the rug according to the area for which serge is to be applied. Moreover, to improve the efficiency during this manufacturing process, the operator must hold and manipulate a pair of scissors throughout the application of the serge. The constant holding and usage of the scissors further increases the risk of injury to the operator and the operator's hands.

SUMMARY OF THE INVENTION

It is an object of the present invention to provide a serge applying assembly for sewing serge around the edge of a section of material without the operator having to physically release the material.

It is an additional object of the present invention to provide a serge applying assembly that will make an automatic incision in the material at the desired point on which the serge is applied along the edge.

It is a further object of the present invention to provide a serge applying assembly that increases the efficiency of the operator in applying serge around the edge of a section of material.

It is yet a further object of the present invention to provide an automatic serge applying assembly that is able to reduce the risk of injury to the operator applying the serge to the material.

These and other objects of the present invention are accomplished by the automatic serge applying assembly of the present invention. The serge applying assembly of the present invention includes a conventional sewing or serging machine that is able to sew the desired serge onto the edges surrounding a section of material. The sewing machine preferably includes a pressure foot and a feed dog for engaging and pulling the material to be sewn and cut. A cutting assembly is additionally included in the present invention, with the cutting assembly attached to the sewing machine in a position proximate the sewing needle. The cutting assembly is able to engage the material and make the desired cut into the material to aid the operator in applying serge around the perimeter of the material. The cutting assembly preferably includes a pneumatic cylinder having a piston, with a blade mechanically connected to the piston of the pneumatic cylinder.

The cutting assembly is positioned attached to the sewing machine proximate the pressure foot for easy engagement with the material. The cutting assembly is able to automatically cut the material, preferably perpendicular with respect to the edge of the material, and the operator is then able to rotate the material such that serge may be applied to the next edge of the material. This process is repeated until serge has been applied to the perimeter of the material.

These and other objects, features, aspects and advantages of the present invention will become more apparent from the following detailed description of the present invention when taken in conjunction with the accompanying drawings.

BRIEF DESCRIPTION OF THE DRAWINGS

A serge applying assembly incorporating the features of the present invention is depicted in the accompanying drawings which form portion of this disclosure and wherein.

DESCRIPTION OF THE PREFERRED EMBODIMENT

Figure 1:
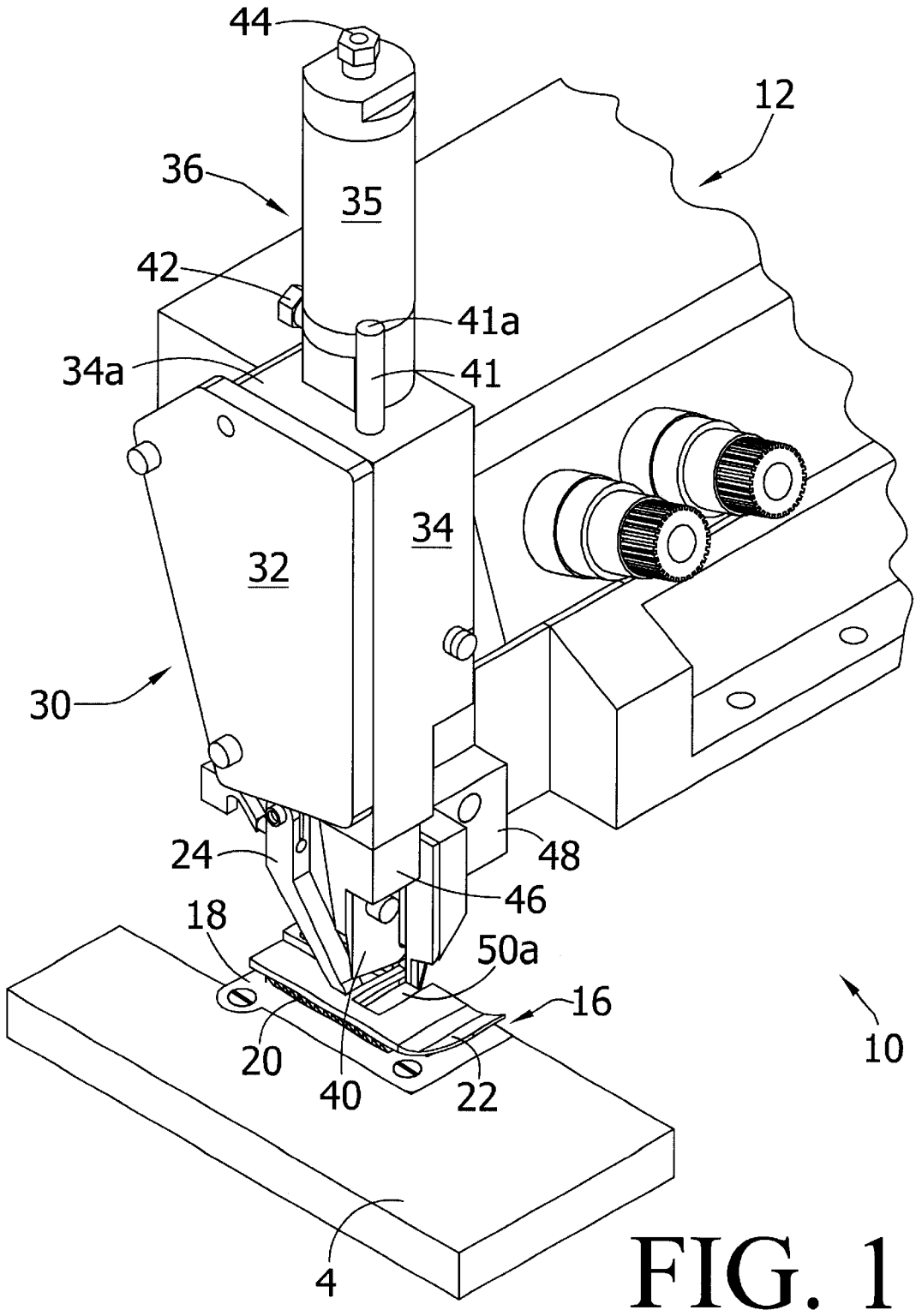
FIG. 1 is a perspective view of a serge applying assembly of the present invention.
Figure 2:
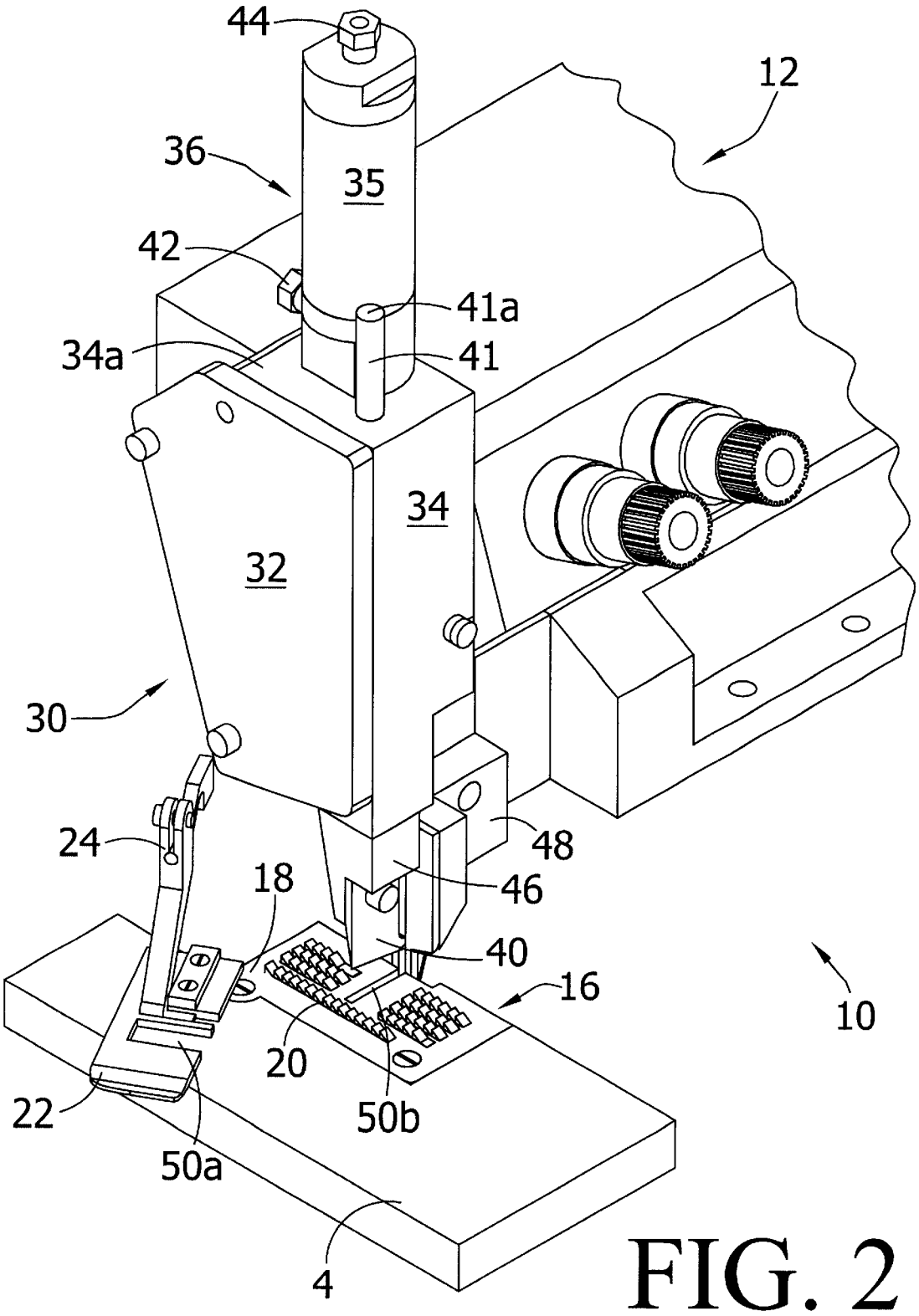
FIG. 2 is a perspective view of the serge applying assembly as illustrated in FIG. 1, with the pressure foot being offset from the sewing machine.
Figure 3:
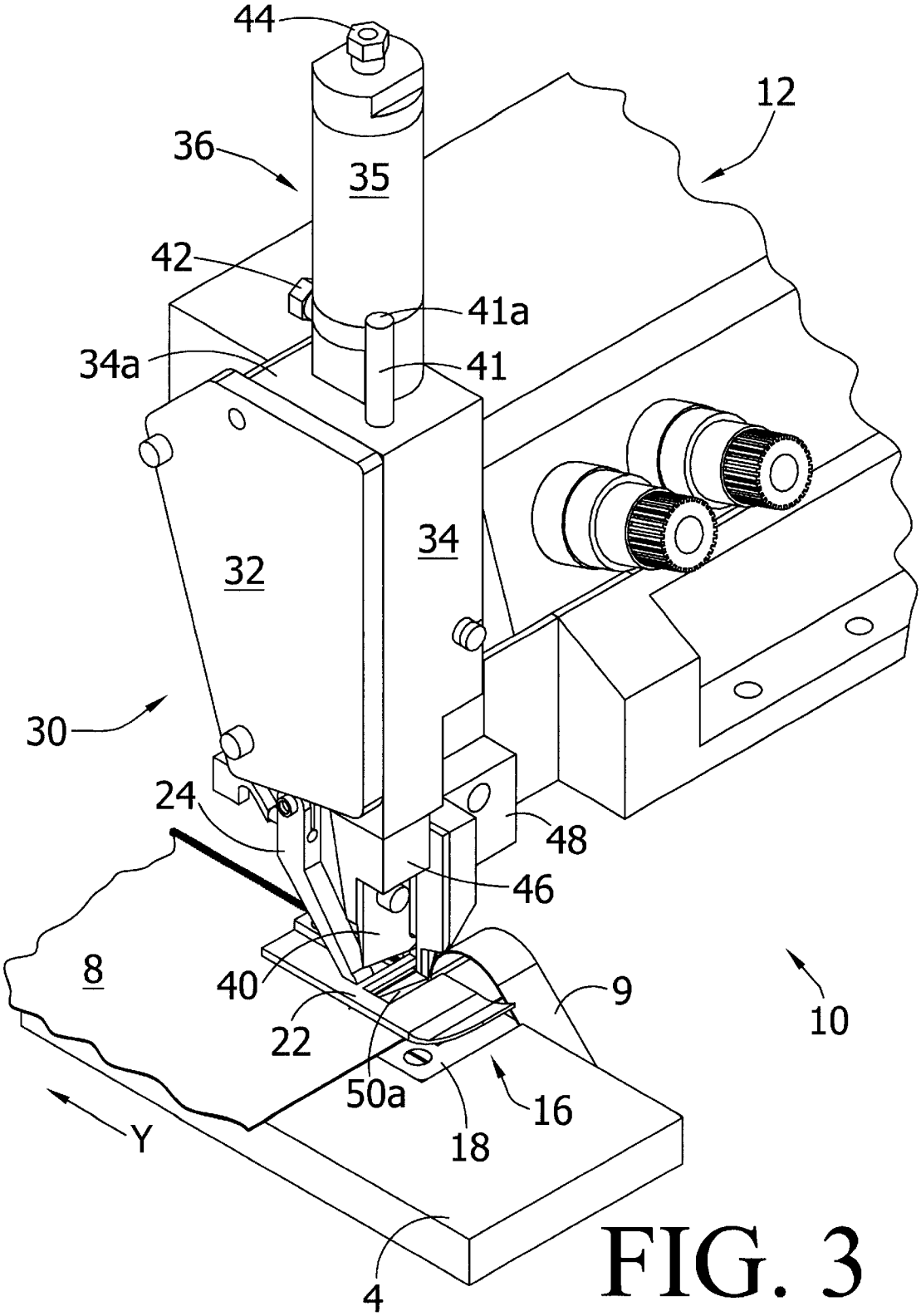
FIG. 3 is a perspective view of the serge applying assembly as illustrated in FIG. 1, this view illustrating a section of material having serge applied to one edge of the material.
Figure 4:
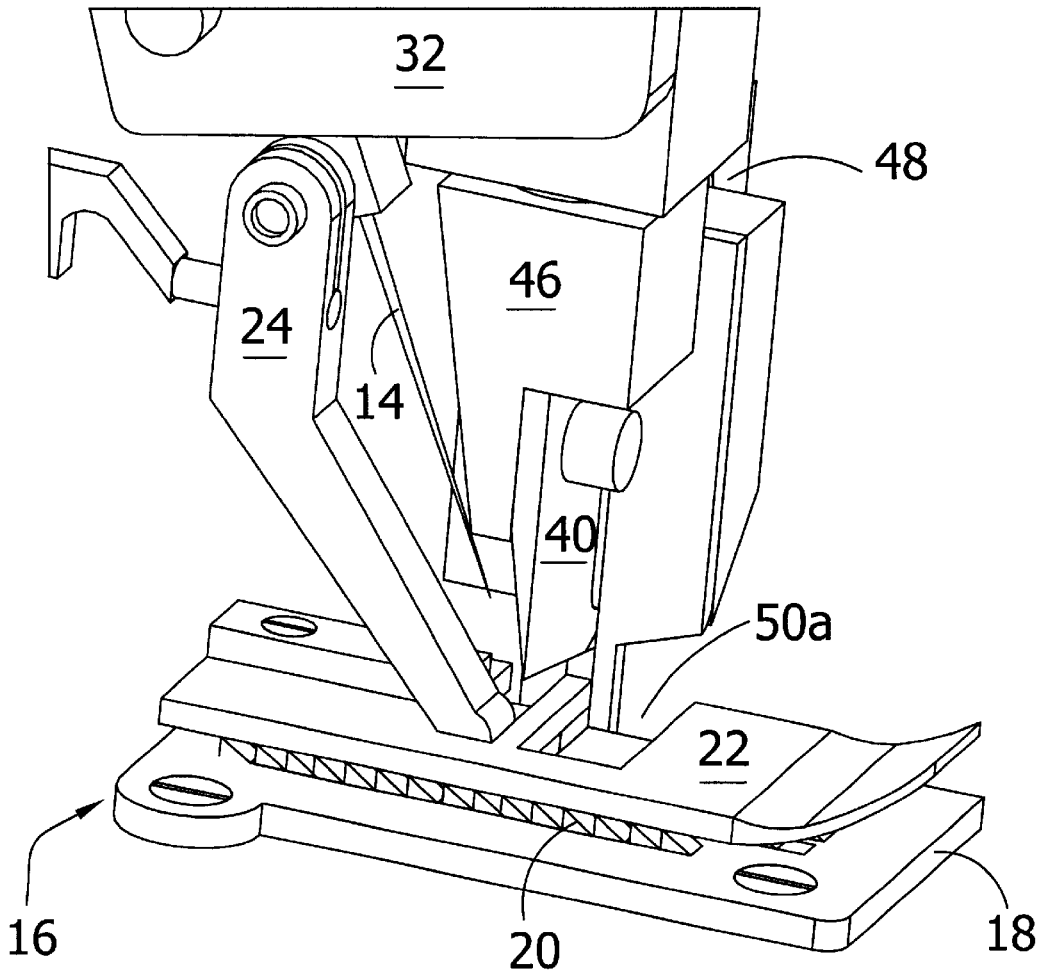
FIG. 4 is a magnified perspective view of a portion of the serge applying assembly as illustrated in FIG. 1.

Looking at FIGS. 1 through 3, the serge applying assembly 10 of the present invention is illustrated. The serge applying assembly 10 is employed to simplify the process by which an operator can apply serge 6 to the edge of a section of a material 8, such as a carpet, a throw, or a rug. The serge applying assembly 10 includes a conventional sewing or serging machine 12, with a cutting assembly 30 integrally connected to the sewing machine 12. The sewing machine 12 used in the present invention can be any one of various sewing machine designs that are known in the art. In the preferred embodiment, the sewing machine 12 is one having a motor-driven sewing needle 14 and a feed dog 16 (see FIG. 4), with the feed dog 16 including a throat plate 18 (attached to a support plate 4 of the sewing machine 12) and a series of gripping members 20 that traverse the throat plate 18. Moreover, the sewing machine 12 also includes a displaceable pressure foot 22 that is connected proximate the sewing needle 14 of the sewing machine 12 via a pivotal arm 24. The pivotal arm 24 may be rotated toward and away from the sewing machine 12 as desired by the operator (as illustrated in FIGS. 1 and 2) such that the pressure foot 22 may be positioned proximate the feed dog 16 (see FIG. 1) or distanced from the feed dog 16 (see FIG. 2) as desired by the operator. When the pressure foot 22 is proximate the feed dog 16, as shown in FIG. 3, it is able to apply a steady force to the material 8 to secure the material 8 between the pressure foot 22 and the throat plate 18. Consequently, the position of the material 8 is resolutely established as the serge 6 is applied to the material 8 via the sewing needle 14 of the sewing machine 12.

Continuing to view FIGS. 1 through 3, the cutting assembly 30 of the present invention includes a cutting assembly housing 34 that is connected to the sewing machine 12 proximate the sewing needle 14 and the feed dog 16, with a cover plate 32 attached to the cutting assembly housing 34. Looking to FIGS. 5 through 10, the cutting assembly housing 34 has a distal end 34*a* and a proximal end 34*b*, with an actuating apparatus for controlling the movement of a cutting device attached to the distal end 34*a* of the cylinder 34. Preferably, this actuating apparatus includes a pneumatic cylinder 36, although other embodiments, such as a hydraulic cylinder or an electric motor, may be implemented to provide the desired movement of the cutting device. Looking at FIG. 7, the pneumatic cylinder 36 of the present invention, as with conventional designs, includes a cylinder housing 35 partially surrounding a piston 38, such that the piston 38 has an enclosed end (not illustrated) within the cylinder housing 35 and an opposing connecting end 37 that extends away from the cylinder housing 35. The pneumatic cylinder 36 is therefore able to provide a straight and rapid movement of the piston 38, which will provide the required perpendicular incision in the desired material 8 as discussed in further detail herein.

Figure 7:
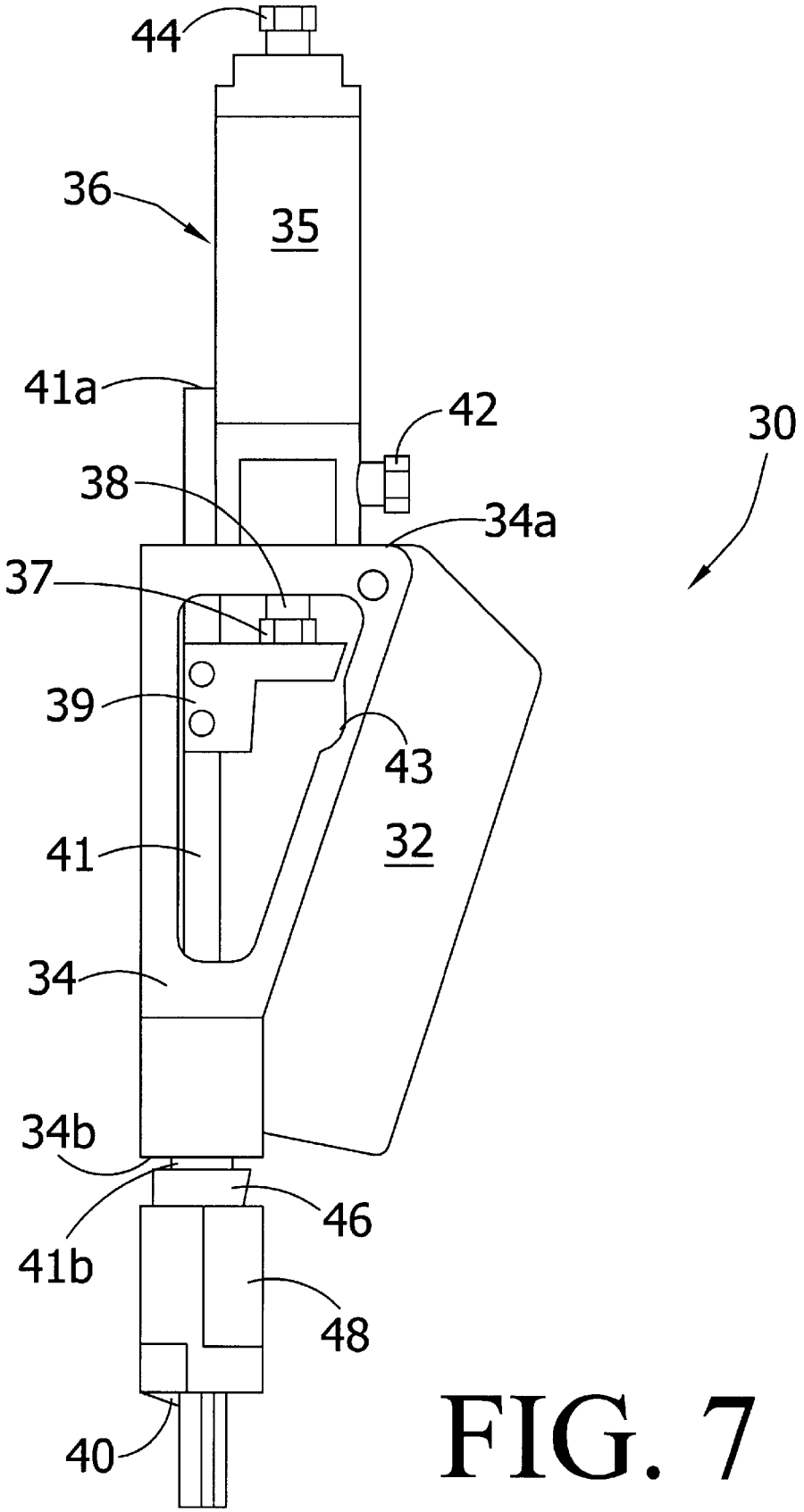
FIG. 7 is a rear elevational view of the cutting assembly of the serge applying assembly of the present invention.
Figure 8:
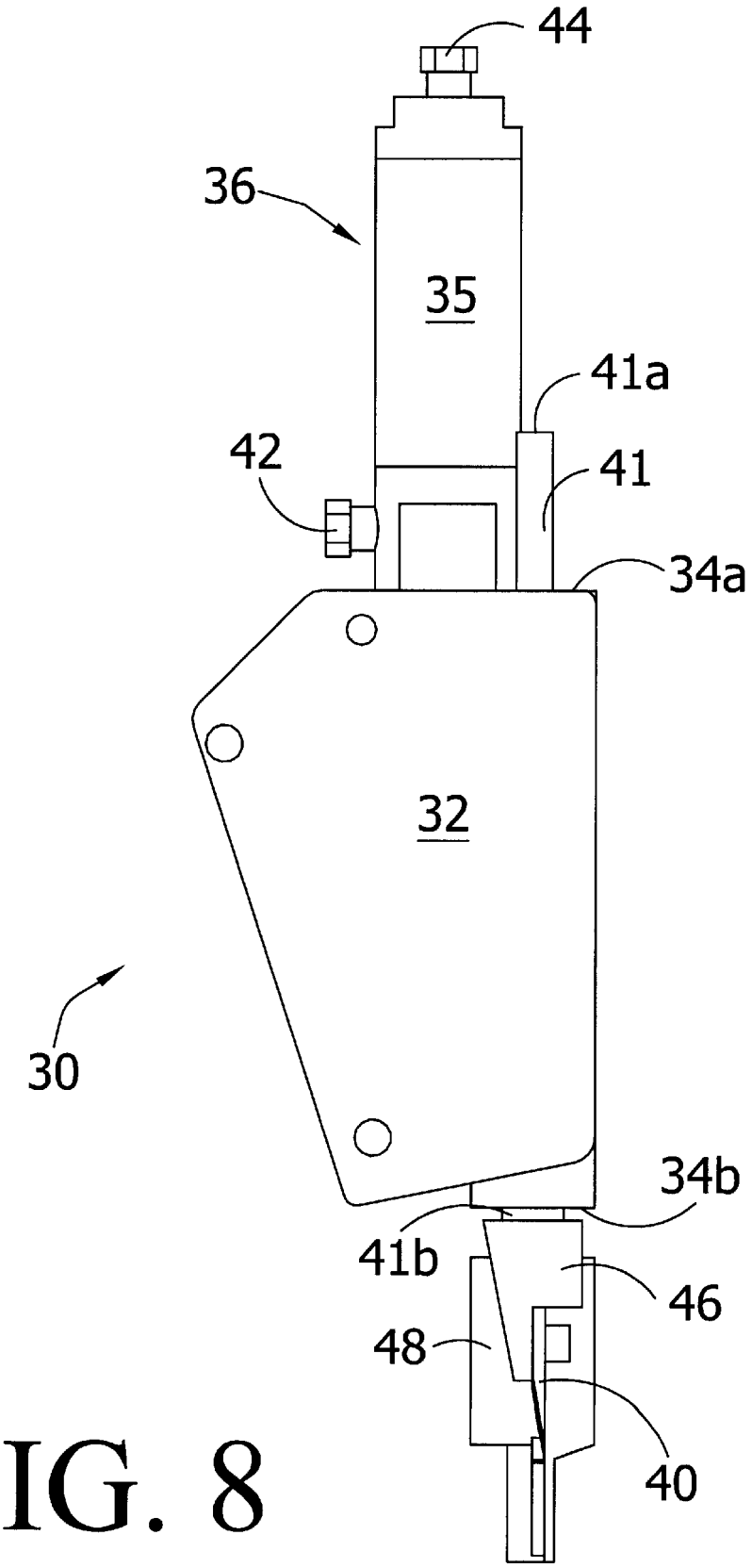
FIG. 8 is a front elevational view of the cutting assembly of the serge applying assembly of the present invention.
Figure 9:
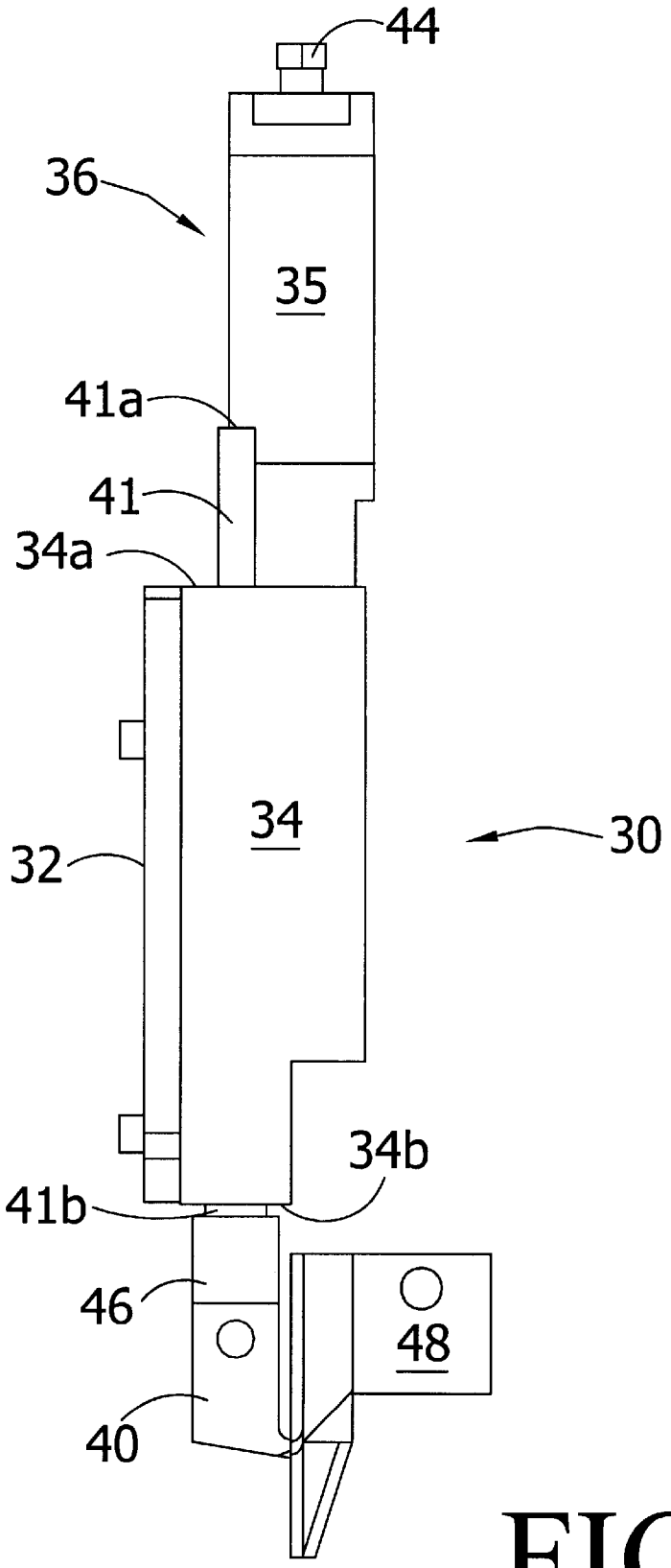
FIG. 9 is a side elevational view of the cutting assembly of the serge applying assembly of the present invention.
Figure 10:
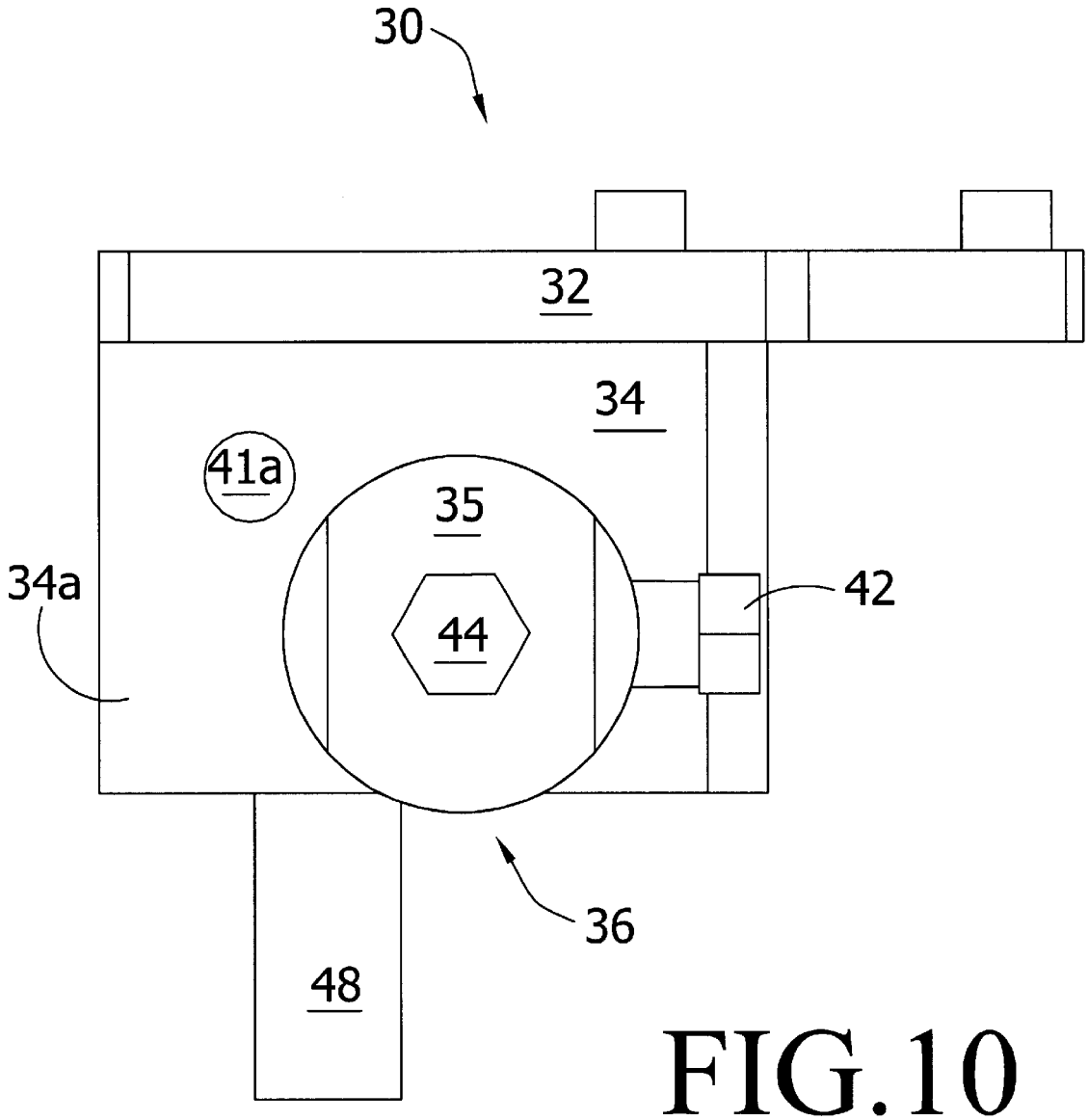
FIG. 10 is a top plan view of the cutting assembly of the serge applying assembly of the present invention.

Continuing to look at FIG. 7, the connecting end 37 of the piston 38 is attached to a linking bracket 39. The linking bracket 39 is preferably L-shaped, with the design allowing a cutting instrument shaft 41 to be rigidly connected to one end the linking bracket 39. Furthermore, looking to FIGS. 5 and 7, the inner surface of the housing 34 includes a ledge 43 that will engage the linking bracket 39 to prevent the linking bracket 39 from extending to far within the housing 34.

The cutting instrument shaft 41 is slidably mounted in the cutting assembly housing 41, with the cutting instrument shaft 41 including a distal end 41*a* and a proximal end 41*b*. The cutting instrument shaft 41 preferably extends from the distal end 34*a* of the cutting assembly housing 34 through the proximal end 34*b* of the cutting assembly housing 34. The proximal end 41*b* of the cutting instrument shaft 41 extends through the proximal end 34*b* of the cutting assembly housing 34, and is further attached to a cutting instrument holder 46. A cutting instrument 40, such as a blade, is additionally connected to the cutting instrument holder 46 such that the piston 38 will control movement of the cutting instrument shaft 41, and therefore the piston 38 will also control movement of the cutting instrument holder 46 and cutting instrument 40. The piston 38 will consequently provide the abrupt movement needed to cut the desired material 8. Looking at FIGS. 3 and 9, a guide member 48 is further attached to the sewing machine 12 such that the guide member 48 is in contact with the cutting instrument holder 46 throughout the movement of the piston 38. The guide member 48 serves to reinforce the desired downward movement of the cutting instrument 40 so as to confirm the accurate direction of the cutting instrument 40 while the cutting instrument 40 is cutting the material 8.

Figure 5:
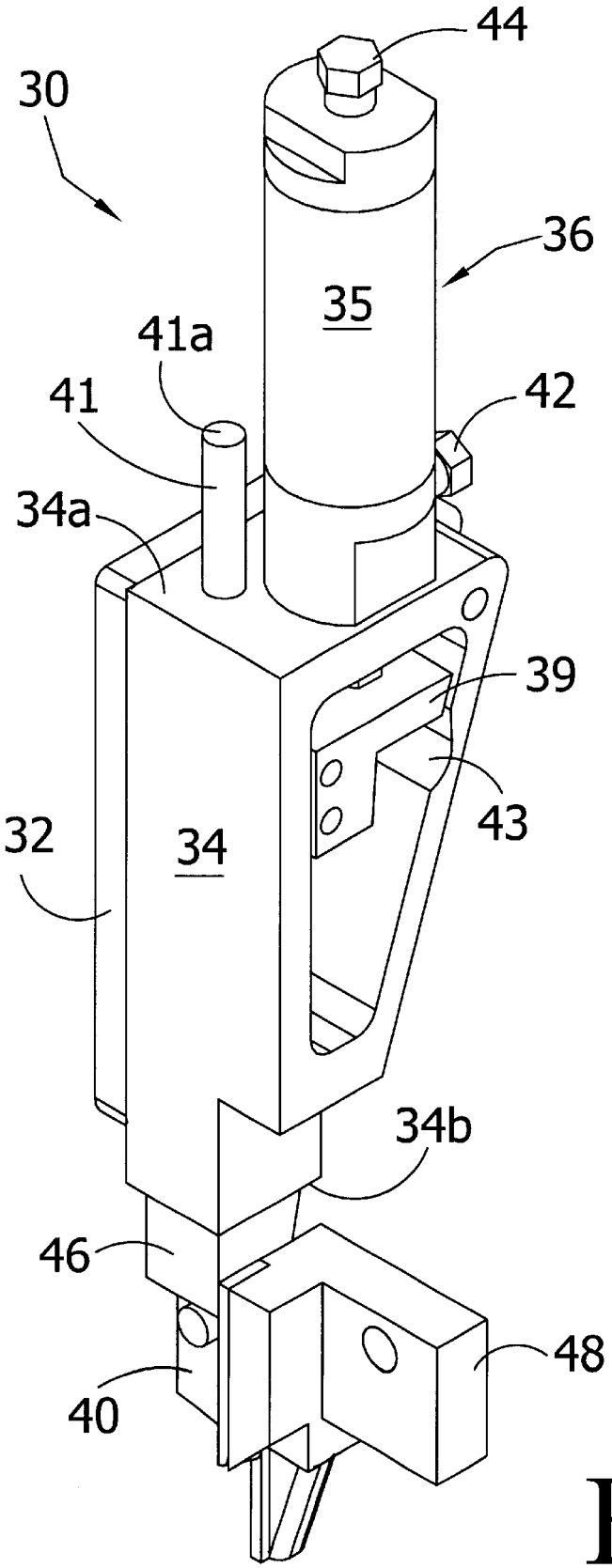
FIG. 5 is a rear perspective view of the cutting assembly of the serge applying assembly of the present invention.
Figure 6:
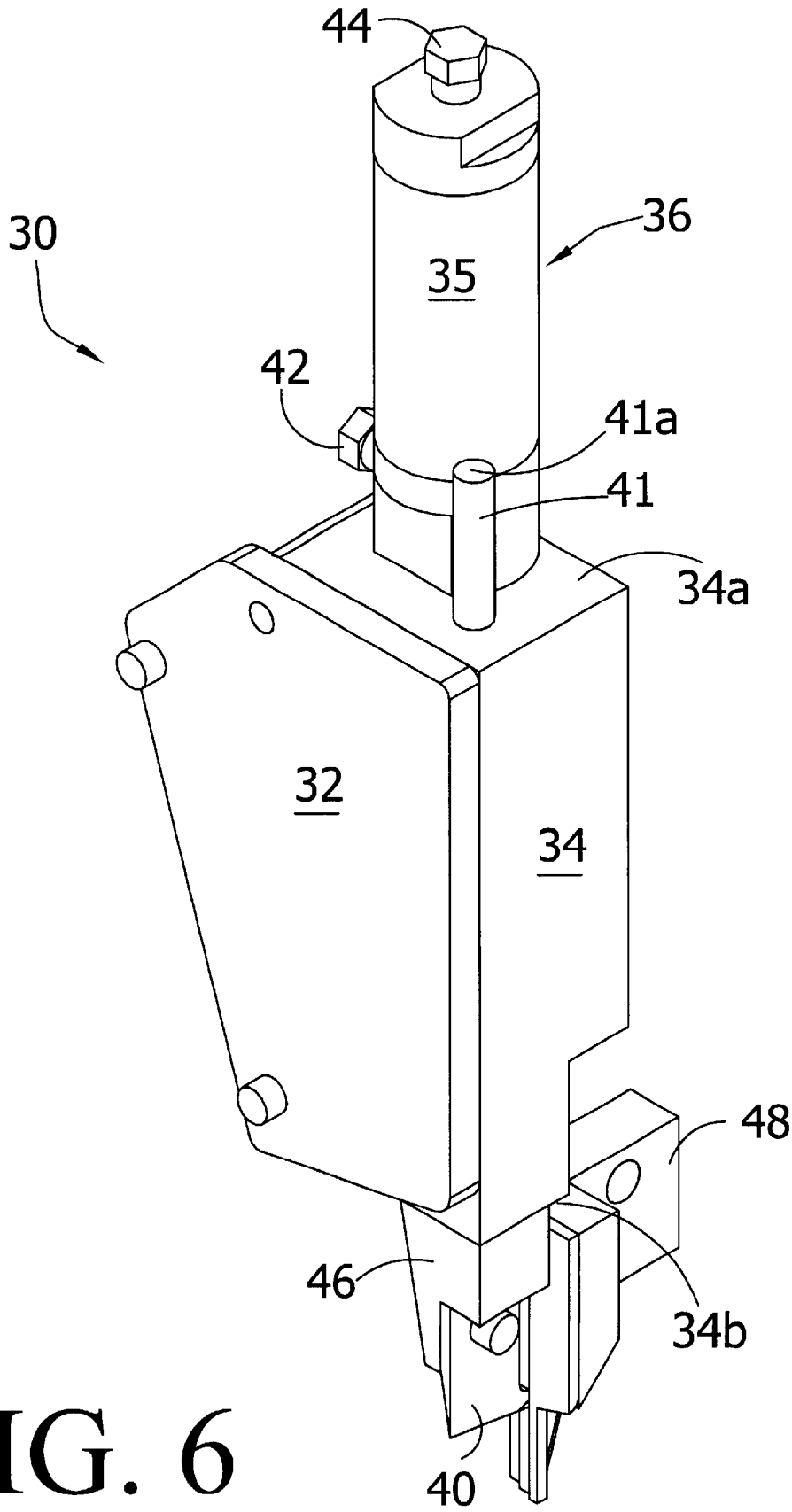
FIG. 6 is a front perspective view of the cutting assembly of the serge applying assembly of the present invention.

Looking at FIG. 5, the pneumatic cylinder 36 of the preferred embodiment includes a triggering means, such as a first pneumatic connector 42 and a second pneumatic connector 44, for controlling the movement of the piston 38 as desired by the operator. The pneumatic connectors 42, 44 are further connected to a cylinder-actuating switch (not illustrated), such that the operator may easily control operation of the pneumatic cylinder 36 to cause the cutting instrument 40 the material in the desired location. In the preferred embodiment, the cylinder-actuating switch is in the form of a pedal switch that may be activated by the operator's foot, such that the operator may easily trigger the cylinder-actuating switch while holding material 8, and thus continue applying serge 6 to the material 8. The operation of the cylinder-actuating switch frees the hands of the operator to provide the operator greater control the application of the serge 6 to the material 8.

Referring back to FIGS. 1 through 4, the pressure foot 22 and the feed dog 16 both include cutting grooves 50*a*, 50*b* that correspond to the position of the cutting instrument 40. The cutting grooves 50*a*, 50*b* are positioned within the pressure foot 22 and the feed dog 16 such that the cutting instrument 40 will be able to traverse both grooves 50*a*, 50*b* when the pneumatic cylinder 36 drives the cutting instrument 40 downward. As a result, when the material 8 is positioned between the pressure foot 22 and the feed dog 16, the cutting instrument 40 will extend through both of the grooves 50*a*, 50*b*, thereby cutting through the material 8.

Referring now to FIG. 3, the operation of the present invention commences with the material 8 being drawn between the throat plate 18 and the pressure foot 22 via the gripping members 20. The material 8 is drawn by the feed dog 16 in the Y-direction, such that the sewing needle 14 of the sewing machine 12 is able to easily engage the edge of the material 8 to apply the serge 6 to the edge. A stripping member (not illustrated) is connected proximate the feed dog 16 and the stripping member cuts the material 8 as it is drawn by the feed dog 16 to remove any undesired scrap material 9. More specifically, the gripping members 20 are rotated via a cam (not illustrated), such that the rotating movement of the gripping members 20 through the throat plate 18 will draw the material 8 between the pressure foot 22 and the throat plate 18 to engage the sewing needle 14.

Once the material 8 is positioned between the pressure foot 22 and the throat plate 18, the sewing needle 14 of the sewing machine will apply the serge 6 to the edge of the material 8. The gripping members 20 will continue to feed the material 8 between the pressure foot 22 and the throat plate 18 such that serge 6 is applied to the desired edge of the material 8.

Once the serge 6 has been applied to the desired edge of the material 8 and the operator is ready to begin applying serge 6 to the next edge perpendicular to the present edge, the operator is then ready to activate the cutting assembly 30. The operator engages the cylinder-actuating switch, which thereby causes the pneumatic cylinder 36 to thrust the cutting instrument 40 through the material 8. The cutting instrument 40 extends through the grooves 50*a,* 50*b,* thereby making the desired incision in the material 8 at the point where the operator is to apply serge 6 to the next edge of the material 8. The operator will then rotate the material 8 at a right angle, and subsequently begin applying serge 6 to the new edge of the material 8. The operator may continue this process until serge 6 has been applied to the surrounding outer perimeter of the material 8.

Multiple benefits are provided by using the serge 6 applying assembly 10 to apply serge 6 to the desired material 8. First, use of the serge 6 applying assembly 10 reduces the amount of time that is required by operators to apply serge 6 around the perimeter of the desired material 8 by eliminating the requirement that the operator stop sewing at each junction of the edges of the material 8 to make an incision in the material 8. The present invention allows the operator to simply activate the cutting assembly 12 using a simple cylinder-actuating switch, preferably activated by the foot or leg of the operator, and the cutting assembly 12 will make the desired cut into the material 8. Consequently, the operator using the present invention is able to process an increased number of material portions 8 in a set period of time as compared to an operator of using the prior art methods for applying serge. Additionally, the use of an automatic cutting instrument 40 to cut the material 8 at the desired location eliminates the requirement that the operator hand-cut the material 8 with scissors. Consequently, the potential for injury of the operator using the sharp instrument is reduced.

Thus, although there have been described particular embodiments of the present invention of a new and useful SERGE APPLYING ASSEMBLY, it is not intended that such references be construed as limitations upon the scope of this invention except as set forth in the following claims.

What is claimed is:

1. A serge applying assembly for applying serge to a first and second edge of a material, the serge applying assembly comprising:

a sewing machine for sewing the serge to the material;

a cutting assembly attached to said sewing machine, said cutting assembly including:

a housing attached to said sewing machine, said housing having a distal and proximal surface;

an actuating apparatus mounted to said distal surface of said housing; and a cutting instrument connected to said actuating apparatus, wherein said actuating apparatus extends and retracts said cutting instrument; and triggering means for controlling said extension and retraction of said cutting instrument, wherein said triggering means is coupled to said actuating apparatus;

wherein said cutting assembly provides an incision in the first edge of the material to establish the second edge of the material.

2. The serge applying assembly as described in claim 1 wherein said actuating apparatus includes a pneumatic cylinder mounted to said sewing machine.

3. The serge applying assembly as described in claim 2 wherein said pneumatic cylinder includes a cylinder housing partially surrounding a piston having a first and second end, wherein said first end of said piston is movably positioned within said cylinder housing and said second end of said piston is connected to said cutting instrument.

4. The serge applying assembly as described in claim 1 wherein said cutting instrument is a blade.

5. The serge applying assembly as described in claim 1 wherein said triggering means includes a first pneumatic connector attached to said actuating apparatus and a second pneumatic connector attached to said actuating apparatus.

6. The serge applying assembly as described in claim 1 further comprising:

a guide member attached to said sewing machine; and a cutting instrument holder connected between said actuating apparatus and said cutting instrument;

wherein said cutting instrument holder resiliently contacts said guide member during said extension and retraction of said cutting instrument.

7. The serge applying assembly as described in claim 1 wherein said sewing machine further comprises:

a pressure foot having a first groove; and a feed dog having a second groove;

wherein said pressure foot is proximate said feed dog such that the material is secured between said pressure foot and said feed dog;

wherein said cutting instrument traverses said first groove and said second groove to cut the material.

8. A method for continuously applying serge to a first and second edge of a material, the method comprising the steps of:

a) providing a sewing machine for applying the serge to the first edge of the material, said sewing machine including a feed dog and a pressure plate positioned proximate a sewing needle;

b) providing a cutting assembly attached to said sewing machine;

c) drawing the material between said feed dog and said pressure plate;

d) sewing the serge onto the edge of the material with said needle;

e) engaging triggering means connected to said cutting assembly to cut the second edge of the material; and f) rotating the material such that the second edge is proximate said sewing needle.

9. In combination with a sewing machine assembly having a pressure foot with a first groove, a feed dog having a second groove, and a sewing needle for applying serge to a first edge of a material, wherein the improvement comprises a cutting assembly attached to the sewing machine proximate the needle, the cutting assembly comprising:

a housing attached to the sewing machine, said housing having a distal and proximal surface;

an actuating apparatus mounted to said distal surface of said housing; and a cutting instrument connected to said actuating apparatus, wherein said actuating apparatus drives said cutting instrument through the first groove and the second groove;

triggering means for controlling the movement of said cutting instrument, wherein said triggering means is connected to said actuating apparatus;

wherein said cutting assembly provides an incision in the first edge of the material to establish the second edge of the material.

10. The combination as described in claim 9 wherein said actuating apparatus includes a pneumatic cylinder mounted to said sewing machine.

11. The combination as described in claim 10 wherein said pneumatic cylinder includes a cylinder housing and a piston, said piston having a first end movably positioned within said cylinder housing and a second end connected to said cutting instrument.

12. The combination as described in claim 9 wherein said cutting instrument is a blade.

13. The combination as described in claim 9 wherein said triggering means includes a first pneumatic connector attached to said actuating apparatus and a second pneumatic connector attached to said actuating apparatus.

14. The combination as described in claim 9 further comprising:

a guide member attached to said sewing machine; and a cutting instrument holder connected between said actuating apparatus and said cutting instrument;

wherein said cutting instrument holder resiliently contacts said guide member during the movement of said cutting instrument.

* * * * *